US006918643B2

(12) United States Patent
Kwag et al.

(10) Patent No.: US 6,918,643 B2
(45) Date of Patent: Jul. 19, 2005

(54) PRINTER CAPABLE OF AUTOMATICALLY ADJUSTING INKJET CLEARANCE FOR PRINTING ON THICK, NON FLEXIBLE PRINTING MATERIAL

(75) Inventors: Chung-Seon Kwag, Seoul (KR); Mina Kwag, Seoul (KR)

(73) Assignee: Gigarox Corporation, Seoul (KR)

( * ) Notice: Subject to any disclaimer, the term of this patent is extended or adjusted under 35 U.S.C. 154(b) by 0 days.

(21) Appl. No.: 10/420,768

(22) Filed: Apr. 23, 2003

(65) Prior Publication Data

US 2004/0212644 A1 Oct. 28, 2004

(51) Int. Cl.[7] ..... B41J 25/308
(52) U.S. Cl. ..... 347/8; 347/37
(58) Field of Search ..... 347/2, 8, 37, 80, 347/101; 101/35; 400/50–59

(56) References Cited

U.S. PATENT DOCUMENTS 5,646,653 A * 7/1997 Fujioka et al. ..... 347/8
5,806,992 A * 9/1998 Ju ..... 400/56
5,872,579 A * 2/1999 Handa et al. ..... 347/8
6,488,422 B1 * 12/2002 Silverbrook ..... 400/56
6,767,074 B2 * 7/2004 Usui et al. ..... 347/19

* cited by examiner

*Primary Examiner*—Stephen D. Meier
*Assistant Examiner*—An H. Do
(74) *Attorney, Agent, or Firm*—GWiPS

(57) ABSTRACT

A printer capable of adjusting a clearance between an inkjet nozzle and a printing material surface is provided for printing not only on regular stationery, but also on thick, non-flexible printing material. This printer equipped an operating menu for selecting a printing function comprises a separable lower and upper frames, a mechanism for adjusting the inkjet clearance, a sensor for detecting the printing material thickness, a computer program for controlling the inkjet clearance, an actuator and power transmitting mechanism for vertically moving the upper frame. Alternatively, an electromagnetic actuator is provided for vertical operation of the upper frame. A process for adjusting the inkjet clearance comprises the steps of: centering and detecting a thickness, adjusting the clearance, detecting the position of the printing material, verifying the printing position comparing with the pre-loaded data, adjusting the position to coincide with the detected position, and printing on the printing subject.

8 Claims, 15 Drawing Sheets

PRINTER CAPABLE OF AUTOMATICALLY ADJUSTING INKJET CLEARANCE FOR PRINTING ON THICK, NON FLEXIBLE PRINTING MATERIAL

BACKGROUND OF THE INVENTION

1. Field of the Invention

The present invention relates to a printer which is used to print not only on regular stationery, but also on cartoon-board or thick, non-flexible printing material. More particularly, the printer equips a mechanism to automatically and continuously adjust inkjet clearance between an inkjet nozzle and a printing material surface for printing on thick, non-flexible printing material.

2. Description of the Related Art

Generally, an inkjet printer has a mechanism for injecting or spraying extremely fine ink droplets onto a sheet of paper to print characters, images or pictures. The printer adopting this kind of inkjet method equips an injection head having a plurality of tiny nozzles to spray the ink droplets directly onto the paper.

The ink contained in the nozzle is heated by a heating element, and expanded out of the nozzle for injection onto the paper.

In accordance with the characters, images or pictures to be printed, the injection head travels horizontally, and selectively operates the appropriate nozzles to print the intended characters, images or pictures. At this point, the injection head attached on the carrier is driven by a carriage motor, and the carrier travels horizontally, either rightward or leftward, along the horizontally extended carrier shaft.

The components of a typical inkjet printer consist of a line feed mechanism, a carriage mechanism, a home assembly, a friction roller assembly, a carriage drive motor, a line feed drive motor, etc. being assembled and installed onto a printer frame.

The line feed mechanism is comprised of a frame base assembly and feed rollers. The paper-feeding assembly feeds a sheet of paper toward the ink injection head, which is attached to the carriage of the carriage mechanism. The ink injection head is integrally assembled with an ink chamber and an ink cartridge.

The ink cartridge is usually replaceable. The injection head is placed at the bottom face of the ink cartridge, against the surface of a sheet of paper. When a sheet of paper arrives at the contacting point between the feed roller and the friction roller, the sheet of paper is picked up by the rollers. Then, the feed roller, driven by the line feed drive motor, passes the sheet of paper to the injection head for printing the characters, images or pictures on the paper. The printed paper is then discharged to the outside of the printer.

Because the quality of printing is affected mainly by the size and impacting force of the ink droplets on the paper, it is important to maintain the optimum clearance between the injection head and the paper surface. In order to achieve the highest print quality, the injection head must be properly positioned to maintain optimum clearance for injecting the ink droplets onto the paper. If the actual print injection clearance is less than or greater than the optimum clearance, print quality would be adversely affected, as would be evident in the resulting deformation of pictorial elements brought about by inappropriate impacting force and size of ink droplets onto the paper.

Even when the ink injection head is properly set for optimum clearance, print quality may vary due to the varying thickness of printing materials.

Korea Patent No. 1998-0000949 discloses a printer having an adjustable inkjet clearance for obtaining optimum print quality. The conventional inkjet printer comprises a mechanism for automatically adjusting injection head clearance according to the paper thickness as detected with sensing devices.

Because the conventional printer adjusts injection head clearance by way of a cam, the adjusting range is limited; although it can print on paper that is slightly thicker than standard stationery, letter envelope, label, etc., it cannot print on cartoon-board, or thick, non-flexible printing material such as rigid cartoon paper or materials such as plastic, wood board, CDs, books, etc.

SUMMARY OF THE INVENTION

To solve the aforementioned problems, an objective of the present invention is to provide a printer having printing capability not only on regular stationery, but also on cartoon-board and thick, non-flexible printing material, by adjusting inkjet clearance between the inkjet nozzle and the printing material surface. The printer of the present invention comprises a printing material feeding part (10) for supplying printing material to the printer and a main body portion (20) equipped with an operating menu for selecting a printing function using either regular stationery or thick, non-flexible printing material. The main body portion of the printer (20) comprises a lower frame (27) and an upper frame (29), each separable from the other, and a set of mechanisms for positioning the upper frame (29) upward or downward to adjust inkjet clearance.

The set of mechanisms for adjusting inkjet clearance comprises a sensor (23) for detecting the thickness of the printing material, a computer program loaded in the computer processor for controlling and adjusting inkjet clearance based on the data detected from the sensor (23), an actuator (24) for receiving a signal from the computer processor and driving a reversible motor (25), and a set of power transmitting mechanisms for moving the upper frame (29) vertically upward or downward for automatically and continuously adjusting the inkjet clearance. Alternatively, a pair of electromagnetic actuators (31, 32) is provided for automatically and continuously shifting the upper frame (29) vertically upward or downward to adjust the inkjet clearance.

The printing material feeding part (10) comprises a top feeder for regular stationery and a horizontal or level feeder for cartoon-board or thick, non-flexible printing material. The feed mechanism (102) of the lower frame (27) alternatively comprises a feed belt system (606, 607).

Another objective of the present invention is to provide a process for automatically and continuously adjusting the inkjet clearance between the inkjet nozzle and the printing material surface for printing on cartoon-board or thick, non-flexible printing material, the process comprising the steps of: centering and aligning the printing material via a subroutine (S100), detecting the thickness of the printing material (S200), adjusting inkjet clearance between the injector and the printing material surface (S300), detecting the position of the printing material (S400), verifying the printing position by comparing the position of the printing material with the position data pre-loaded in the computer (S500), adjusting the position of data in the computer to coincide with the detected position of the printing material (S450), printing on the printing material (S600), and discharging the printed material to the receiving part (S600).

Another objective of the present invention is to provide a process for automatically and continuously adjusting the inkjet clearance to print on an oversized printing material surface, the process comprising the steps of: disassembling the upper frame (29) of the printer, installing a pair of guide rails over the oversized printing material, setting the upper frame (29) of the printer on the pair of guide rails installed over the oversized printing material, connecting the upper frame (29) of the printer to the computer system, verifying the printing position as compared with the position of pre-loaded data in the computer, adjusting the position data in the computer to coincide with the detected position of the printing material, printing on the oversized printing material. Alternatively, a pair of guide belts system is adopted to mount the upper frame (29) over the oversized printing material.

DETAILED DESCRIPTION OF THE PREFERRED EMBODIMENTS

In order to accomplish the aforementioned objectives, a new concept of a printer with a new function is developed. Herein, the present invention will be described in detail, along with the accompanying drawings. The explanations of the components, which are the same in the present invention as in conventional technology, will be omitted in the following description.

Figure 1:
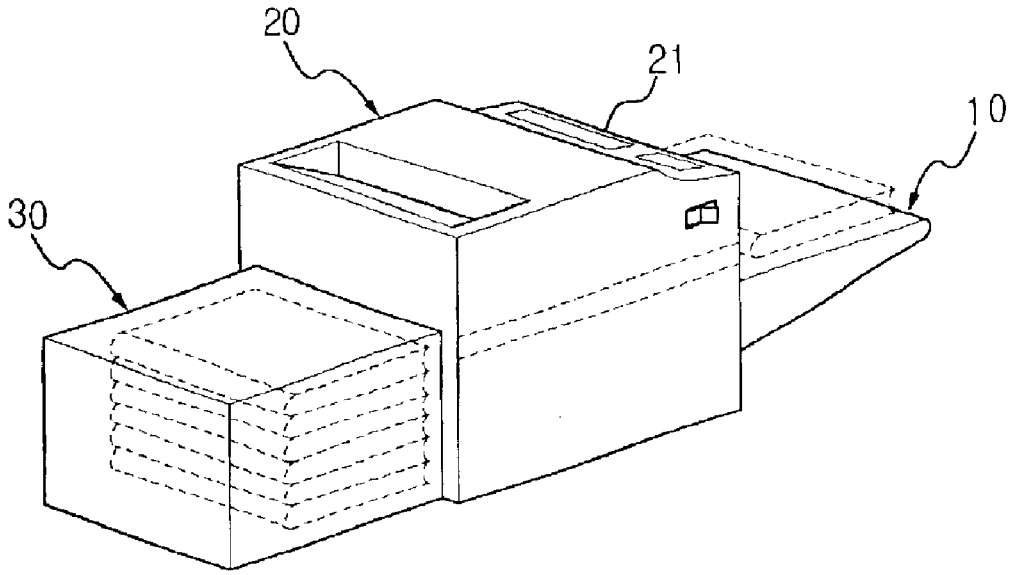
FIG. 1 is a conceptual printer layout which is capable of automatically adjusting inkjet clearance according to the present invention.

As shown in FIGS. 1 through 4, the conceptual printer layout of the present invention is disclosed. The implementing example of the present invention shows the fully automated feature for the entire printing process, from the feeding of the printing material to completion of printing. As shown in FIG. 1, the printer is divided into three major parts, a paper feeding part for supplying printing material (10), the main body of the printer (20), and the receiving part (30) for receiving discharged printing material.

A control panel (21) located at the top front portion of the main body (20) displays an operating menu. Through the operating menu, it is possible to select a printing function using either regular stationery or special printing material. When printing on regular stationery, the paper is supplied from the top feeder of the printer. When printing on special printing material, the printing material is supplied horizontally through the feeding part located at the front of the printer.

Figure 2:
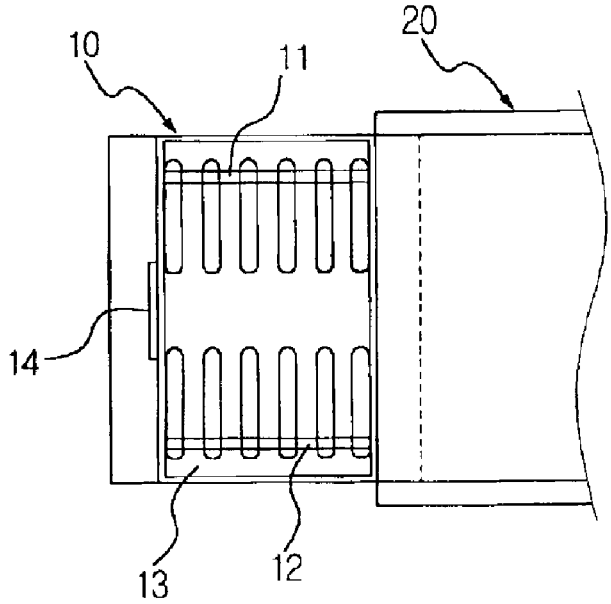
FIG. 2 is a plan view of a printing material rack.
Figure 3:
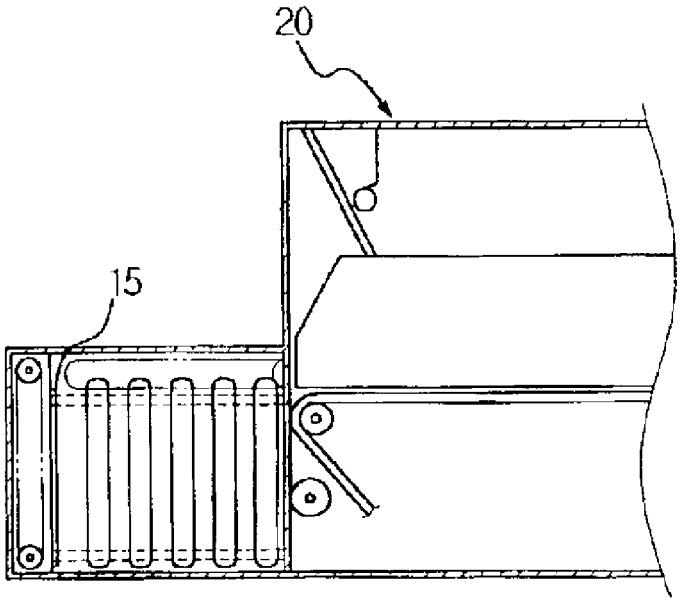
FIG. 3 is a side view of a printing material rack and an inlet part of the main body of the printer.

Referring to FIGS. 2 and 3, the supplying part (10) is comprised of a pair of side panels (11, 12), a front panel (14), a bottom panel (13) and a set of mechanisms. The printing material supplying part (10) is a kind of basket or rack for temporarily storing and feeding the printing material into the printer. If the rack is empty, a sensor in the printing material supplying part detects the vacant state of the rack, in which case all panels return to their initial positions, i.e., each side panel moves back to its respective side edge, the front panel returns to the front edge, and the bottom panel moves downward to the lowest position. At this moment, when all of the panels are positioned at their initial state, the rack has the largest quantity of printing material.

When the printing material is loaded in the rack and the cover is closed, the sensor detects the loading state. Then, both side panels (11, 12) simultaneously move toward the centerline to align the printing material to the center of the printer until the sensor detects both side ends of the printing material. At the same time, the front panel (14) pushes the printing material toward the front end of the printer until the printing material reaches the front face of the printer. Next, the bottom panel (13) pushes the printing material up until the top surface of the printing material can be pushed and fed into the inlet slot of the printer.

A mechanism is installed underneath the bottom panel of the supplying part (10) for operating the panels of the rack and raising the level of the printing material according to the detected thickness of the loaded printing material.

If a printing signal is not issued, the printer is in standby mode for printing. When the printing signal is issued, the supplying part (10) begins feeding the printing material into the printer. At this time, the sensor (23) disposed above the inlet slot inside of the printer detects the thickness of the printing material and transmits the measured data to the computer processor for controlling an actuator (24). When an operating signal is issued from the computer processor, the actuator (24) drives the reversible motor (25) to adjust inkjet clearance.

Figure 4:
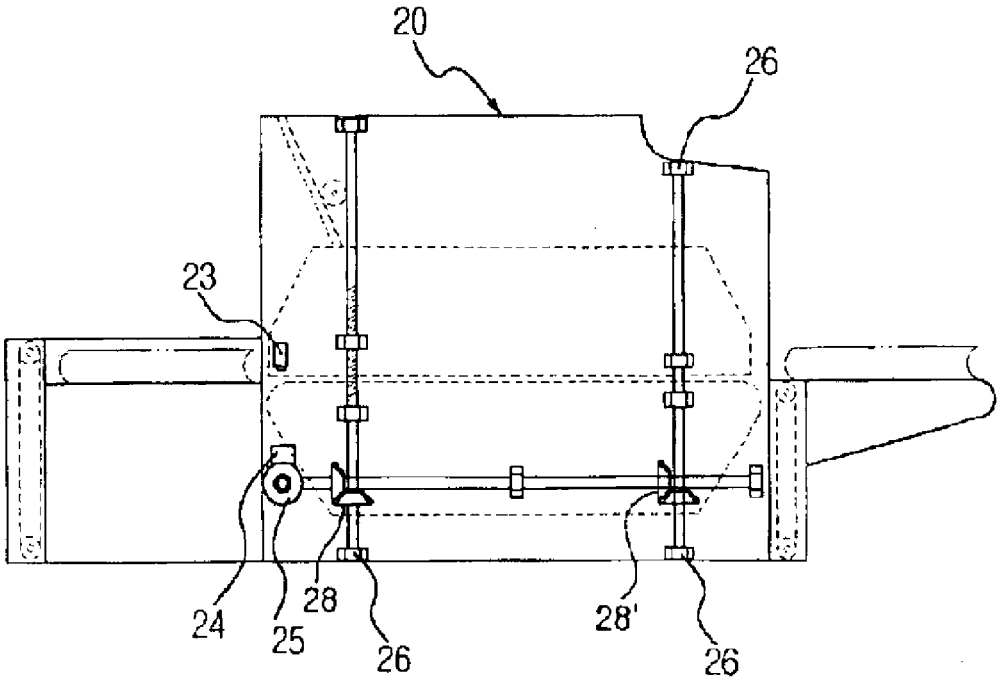
FIG. 4 is a side view of a lower frame, an upper frame and a driving mechanism for adjusting inkjet clearance.
Figure 5:
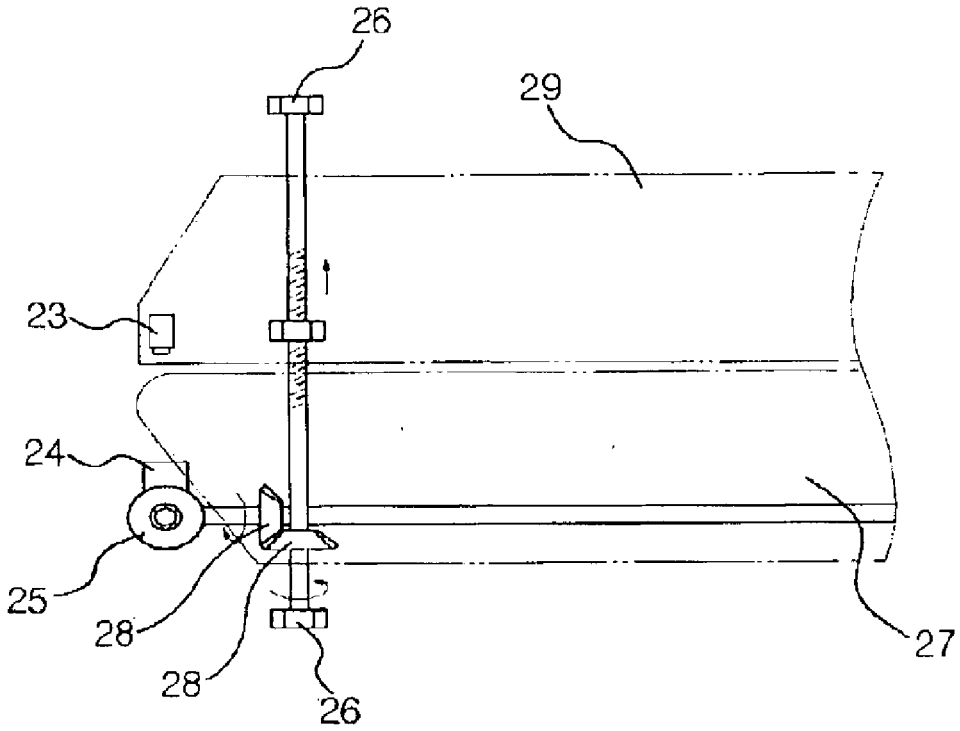
FIG. 5 is a configuration of a driving mechanism for operating the upper frame upward or downward according to the present invention.

As shown in FIGS. 4 and 5, a mechanism is presented to adjust the clearance between the ink injector and the printing material surface. The basic concept of the mechanical adjusting system comprises the steps of: a sensor (23) detects the thickness of printing material and transmits the detected data to the connected computer processor. A controlling program, pre-loaded in the computer processor, transforms the detected data into an electric signal. When the actuator (24) receives the electric signal from the computer processor, the actuator activates the reversible motor (25) to adjust the clearance. The mechanism converts the rotation of the motor to the vertical linear movement of the upper frame. Therefore, the power transmission mechanism enables to automatically and continuously adjust the inkjet clearance. The power transmission mechanism comprises a reversible motor with dual side shafts connected to a pair of bevel gears (28), guide shafts (29), supporting brackets, middle bearings and edge bearings (26).

Figure 6:
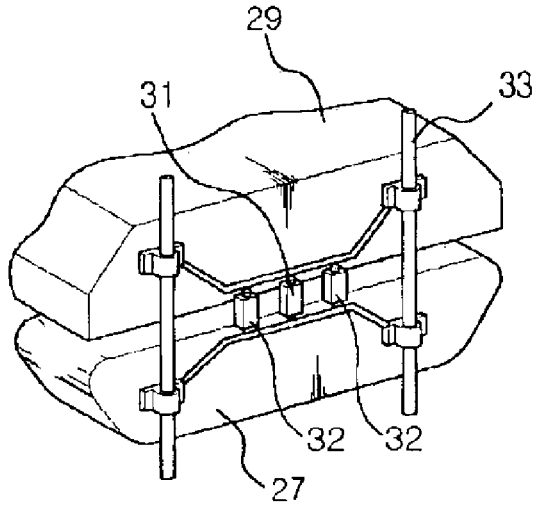
FIG. 6 is a configuration of an electromagnetic device for operating the upper frame upward and downward according to the present invention.
Figure 7:
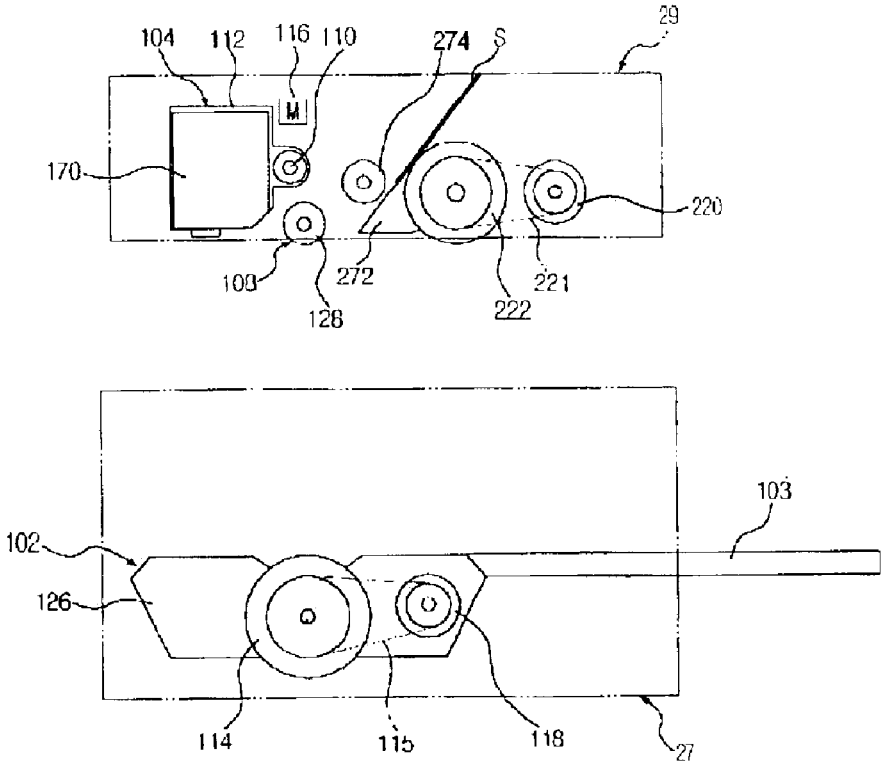
FIG. 7 is a side view of a printer structure consisting of a separable upper frame and lower frame according to the present invention.

As shown in FIG. 6, an electromagnetic adjusting system is disclosed for adjusting inkjet clearance between the ink injector and the printing material surface. The basic concept of the electromagnetic adjusting system comprises the steps of: a sensor detects the thickness of printing material, and transmits the detected data to the connected computer processor. A controlling program, pre-loaded in the computer processor, transforms the detected data to an electric signal. When the electromagnetic actuator (32) receives the electric signal from the computer processor, the electromagnetic actuator begins pulling or pushing up the upper frame by exerting electromagnetic power. The electromagnetic power converts the vertical linear movement of the upper frame to automatically and continuously adjust inkjet clearance. The electromagnetic adjusting system comprises a pair of solenoids or electromagnetic actuators (32), a set of guide rods (33) and a LVDT (31).

The main body of the printer (20) comprises a carriage mechanism (104) formed with an ink cartridge carriage (112) installed on a carriage shaft (110) for horizontally traveling rightward or leftward along the carriage shaft (110) to the horizontal edges, a carriage drive motor (116) for driving the ink cartridge carriage (112) installed on the frame, a rear driving roller (222) and a rear drive motor (220) for driving the rear rollers which are installed at the rear part of the upper frame (29).

The printer comprises an upper frame and a lower frame, each separable from the other. The lower frame consists of a line feed mechanism (102) with a feed roller (114), a line feed motor (118) for driving the feed roller (114), a paper-feeding tray (103) aligned with the line feed mechanism, (102) and a line feed motor (118) for loading printing material. The upper frame (29) further comprises a friction roller (128) in a friction roller assembly (108), which friction roller partially juts out from the bottom line of the upper frame (29), a rear driving roller (222), which also juts out from the bottom line of the upper frame (29). The amount of jutted out the rear driving roller (222) is same as the amount of jutted out the friction roller (128) to align on the same horizontal bottom line.

The friction roller assembly (108) equips a feed roller (114) engaged with the friction roller (128) of the lower frame (27) for feeding printing material.

The printing material feeding part (10) further comprises a top feeder for regular stationery and a horizontal or level feeder for cartoon-board or thick, non-flexible printing material.

The upper frame and the lower frame are able to move only upward or downward, along the four guide rods or shafts, and are not allow to move forward or rearward, right or leftward. The upper frame is also designed to stop at the proper position corresponding to set the optimum inkjet clearance.

As shown in FIGS. 7 through 11, the inkjet printer of the present invention comprises a separable lower frame (27) and upper frame (29).

Figure 8A:
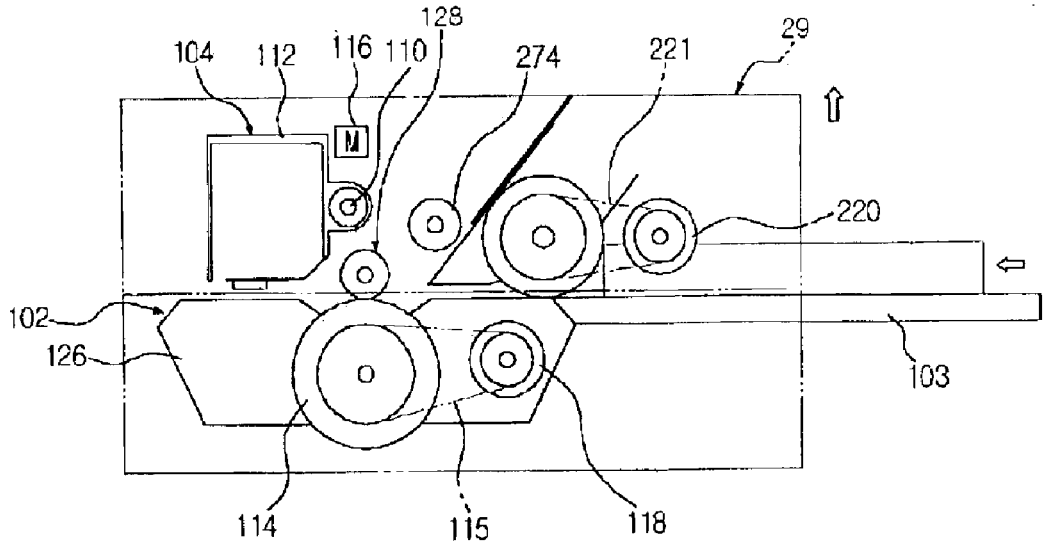
FIG. 8*a* is an initial printing operation status for feeding printing material by way of a friction roller.
Figure 8B:
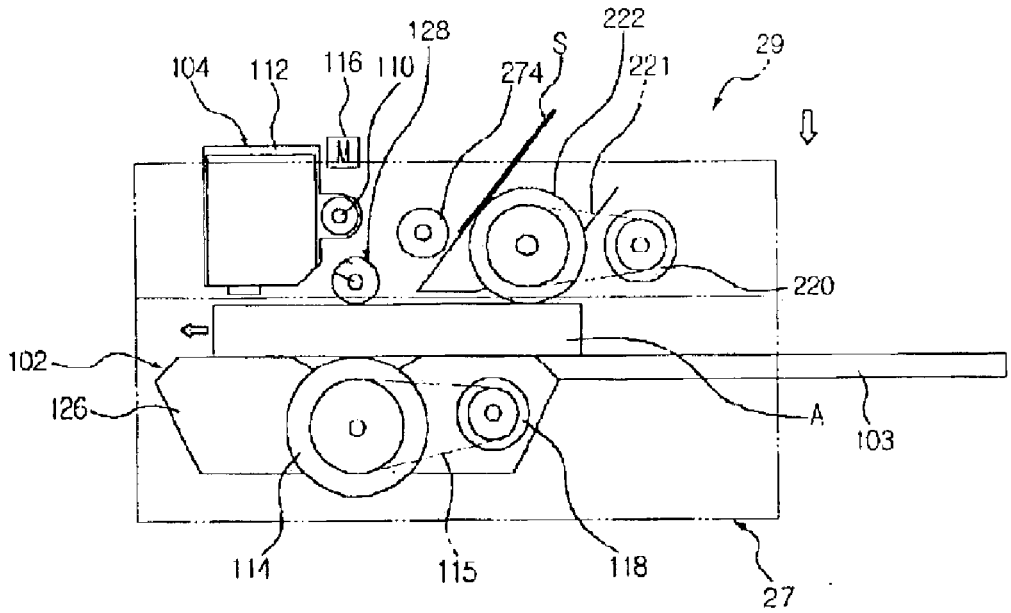
FIG. 8*b* is an intermediate printing operation status indicating that the fed printing material is located underneath the inkjet nozzle.
Figure 8C:
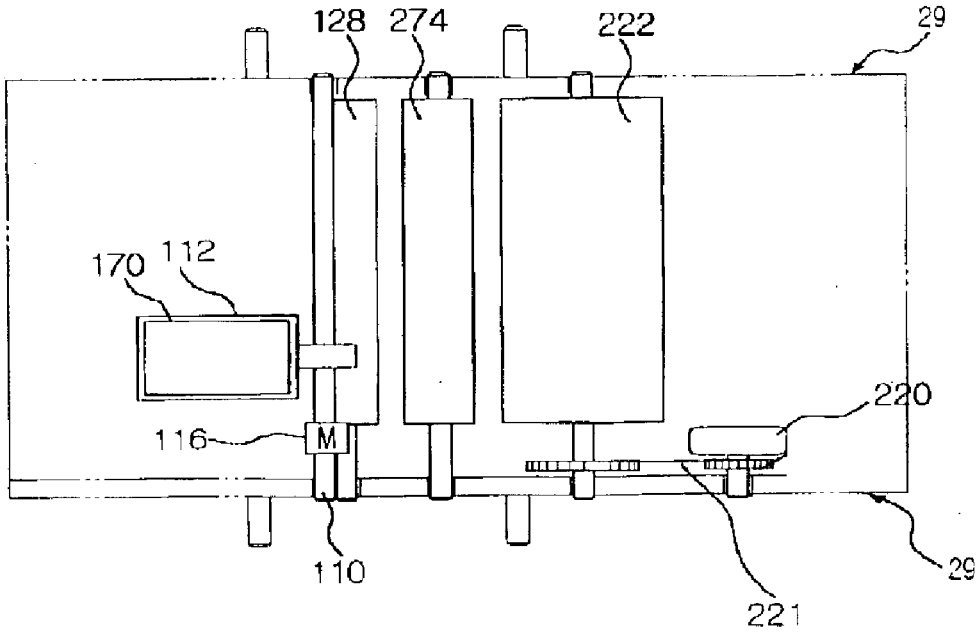
FIG. 8*c* is a plan view of the roller arrangement at the separable upper frame and lower frame.

The line feed mechanism (102) and the line feed drive motor (118) are installed on the lower frame (27). The line feed mechanism (102) consists of a frame base assembly (126) and a feed roller (114) driven by the line feed motor. As shown in FIGS. 8*a* and 8*b*, the feed roller (114) and the line feed drive motor (118) are installed on the shafts, suspended at both edges of the lower frame (27).

The feed drive motor (118) transmits power to the feed roller (114) via a transmission means. In the preferred embodiment, a belt (115) is adopted as a transmission means to link the feed roller pulley to a line feed motor pulley. Instead of pulleys and belts, a set of gear trains or a compact conveyor belt system is alternatively adopted as the transmission means.

On the other hand, the carriage mechanism (104), the friction roller assembly (108) and the carriage drive motor (116) are installed on the upper frame (29). The carriage mechanism (104) consists of the carriage (112) with the ink cartridge (170). The carriage (112), driven by the carriage drive motor (116), moves horizontally rightward or leftward, along the carriage shaft (110). The friction roller assembly (108) is comprised of the feed roller (114) and the friction roller (128). The feed roller (114) and the friction roller (128) engage each other, and together feed the printing material. The friction roller (128) is installed on the friction roller shafts. The carriage shaft (110) and the friction roller shafts are suspended one from each side of the lower frame (27).

At this point, the friction roller (128) in the friction roller assembly (108) is installed so that it partially juts out from the bottom line of the upper frame (29).

A rear driving roller (222) is installed on the rear of the upper frame (29), partially jutting out from the bottom line of the upper frame (29). The protruding portion of the friction roller (128) and the rear driving roller (222) are aligned at the same horizontal level to smoothly feed the printing material. The rear drive motor (220), which drives the rear driving roller (222), is also installed on the upper frame (29). The rear drive motor (220) drives the rear driving roller (222) via a transmission means, such as a belt (221), linked between a rear driving roller pulley and a rear drive motor pulley. Alternatively, a set of gear trains or a belt system could be adopted as the transmission means.

A tray (103) for conveying the printing material is installed such that it extends rearward at the upper rear edge of the frame base assembly (126) in the line feed mechanism (102). The top surface of the tray (103) disposes at the same level as the top surface of the frame base assembly (126).

The upper frame (29) and the lower frame (27) are able to move upward or downward along the guide rods (29). The upper frame moves upward or downward relative to the lower frame (27). Between the upper frame (29) and the lower frame (27), a mechanical or electromagnetic power system is installed to enable the vertical linear movement.

As shown in FIGS. 8*a* through 11*b*, the printing material is loaded onto the feed tray (103), a sensing device detects the thickness of the printing material and transmits the detected data to the computer processor. The pre-loaded program in the computer processor converts the detected data to an electric signal and issues it to the actuator. The actuator initiates the motor, which in turn adjusts the inkjet clearance by vertically moving the upper frame or the lower frame.

Figure 9A:
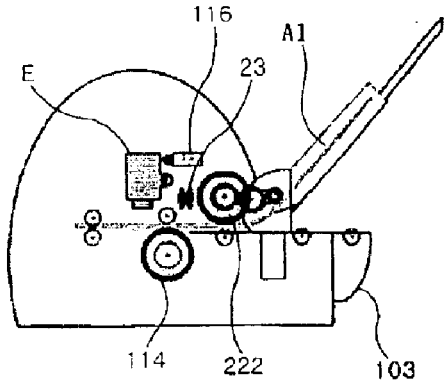
FIG. 9*a* shows a printer with a dual feeding system for supplying printing material from the top feeder and the horizontal level paper feeder.
Figure 9B:
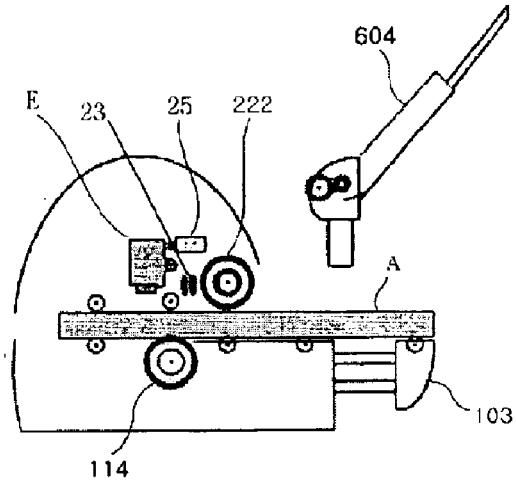
FIG. 9*b* shows a detachable top feeder of the dual feeding system.
Figure 9C:
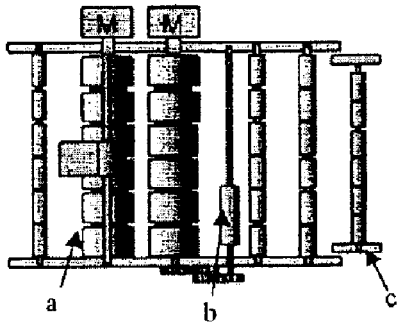
FIG. 9*c* shows an arrangement of the rollers inside the dual feeding system.
Figure 10A:
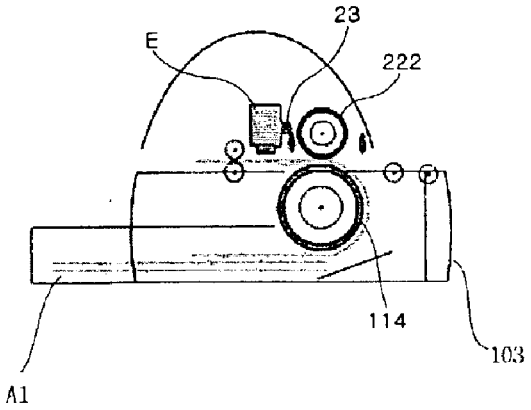
FIG. 10*a* shows a printer with a dual feeding system for supplying printing material from the bottom feeder and the horizontal level paper feeder
Figure 10B:
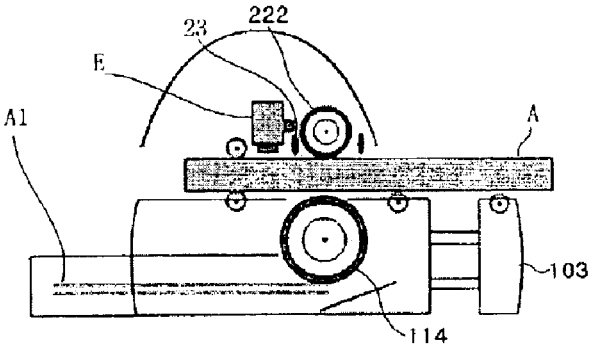
FIG. 10*b* shows a printing process of the thick printing material being fed from the horizontal level paper feeder.
Figure 10C:
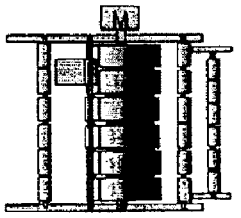
FIG. 10*c* shows an arrangement of the rollers inside the printer

As shown in FIGS. 9*a* and 9*b*, a dual feeding system for supplying the printing materials from the top feeder and the horizontal or level paper feeder is disclosed. The top feeder supplies regular stationery, and the horizontal or level feeder supplies cartoon-board or thick, non-flexible printing material.

Figure 11A:
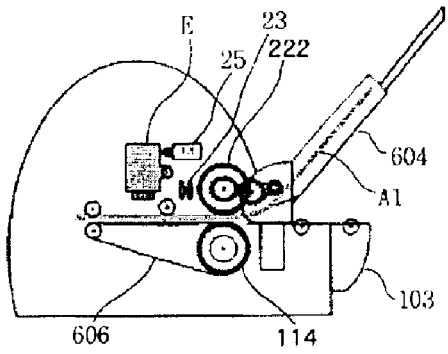
FIG. 11*a* shows a printer with the top feeder and the horizontal level paper feeder driven by a belt driving system.
Figure 11B:
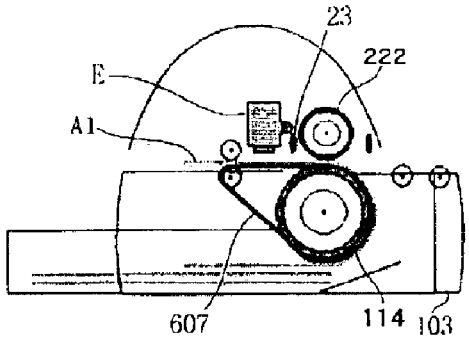
FIG. 11*b* shows a printer with the bottom feeder and the horizontal level paper feeder driven by a belt driving system.
Figure 11C:
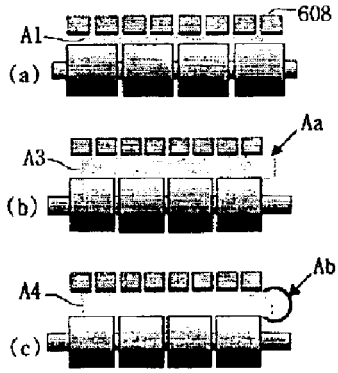
FIG. 11*c* shows the printing conditions for the various thick printing materials in the arrangement of rollers.

As shown in FIGS. 11*a* and 11*b*, the line feed mechanism (102) of the lower frame (27) may be replaced with a belt feeding system (606, 607). The belt system (606, 607) has a merit to confidentially carry the cartoon-board or thick, non-flexible printing material without slippage as occurred in the roller feeding system.

Figure 12A:
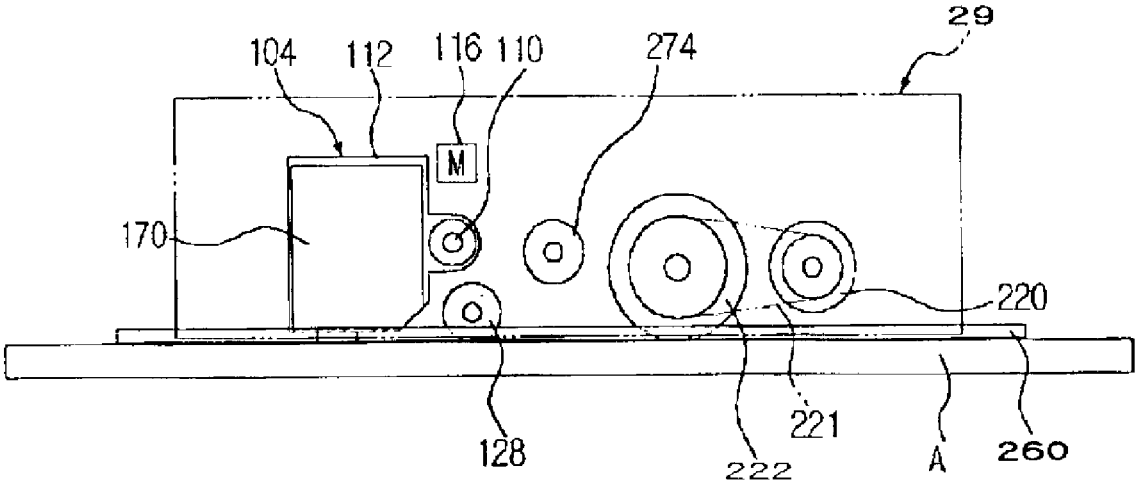
FIG. 12*a* is a side view of an upper frame installed on a guide rail for printing on oversized printing material according to the present invention.
Figure 12B:
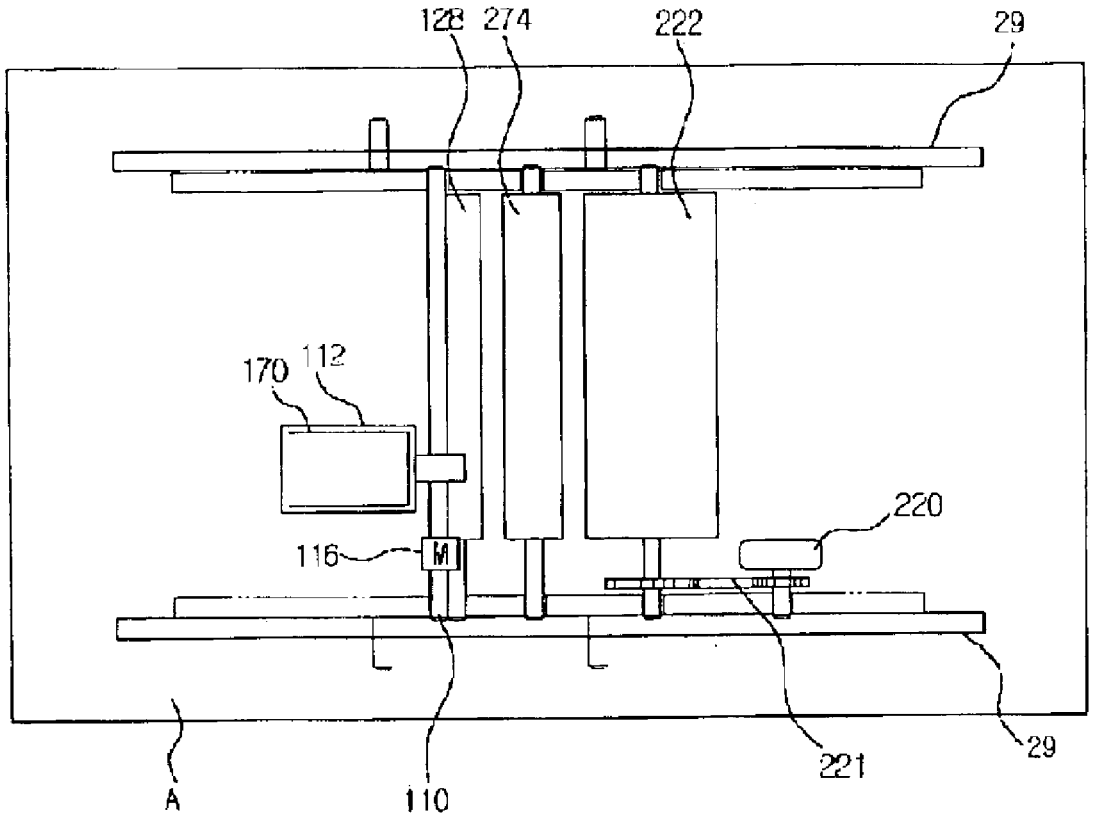
FIG. 12*b* is a plan view of an upper frame installed on a guide rail for printing on oversized printing material according to the present invention.
Figure 12C:
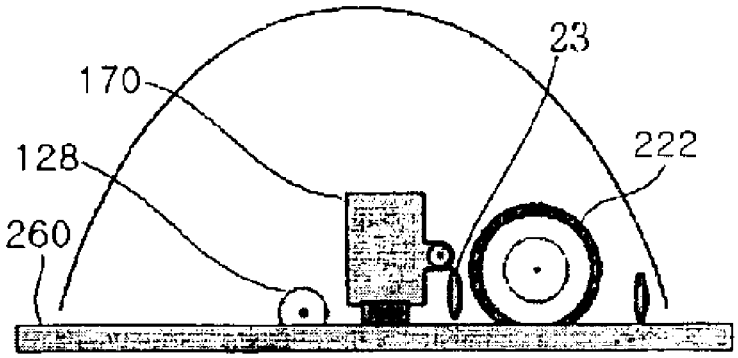
FIG. 12*c* shows an upper frame installed over oversized printing material according to another embodiment of the present invention.
Figure 12D:
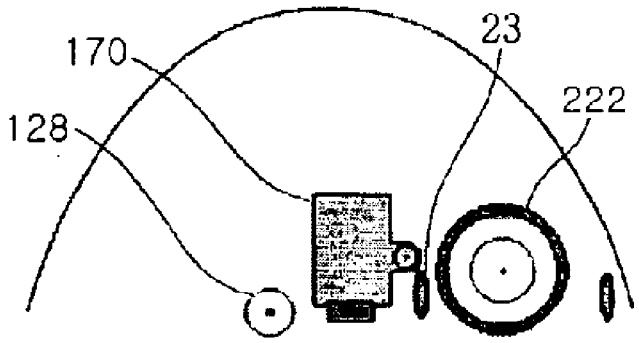
FIG. 12*d* shows a separated upper frame of the printer for printing on oversized printing material.
Figure 13:
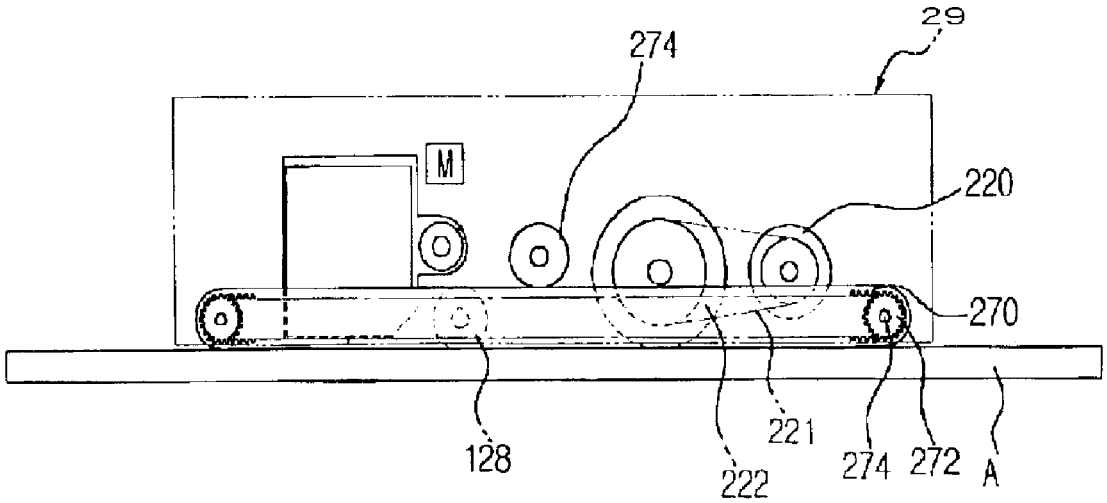
FIG. 13 is a side view of an upper frame installed on a belt system for printing on oversized printing material according to another example of the present invention.

As shown in FIGS. 12*a* through 13, another example of the present invention for printing on oversized printing material (A) which is large and thick non-flexible, is presented. The upper frame (29) is designed to simply detach from the printer frame. A set of guide rails (260) is installed over the oversized printing material (A), and the upper frame (29) is mounted on the guide rails (260). Then, the weight of the upper frame makes the friction roller (128) and the rear driving roller (222) smoothly and closely contact the surface of the oversized printing material.

Next, the rear driving roller (222), driven by the rear drive motor travels and prints on the oversized printing material. Simultaneously, the upper frame (29) installed on the guide rails travels forward or rearward by way of the friction roller (128) and the rear driving roller (222). By driving the carriage drive motor (116), ink droplets are injected from the ink head of the cartridge (170) to the surface of the oversized printing material.

Instead of a guide rail, a belt system (170) can be adopted to operate the upper frame (29), as shown in FIG. 13. A pair of belts (270) assembled with spur gears at the front and rear ends is installed above the oversized printing material (A). Then, the upper frame (29) mounted on the belts travels forward or rearward by way of the friction roller (128) and the rear driving roller (222). By actuating the upper frame on the belt system, it is possible to travel and print on the surface of the oversized printing material.

Figure 14:
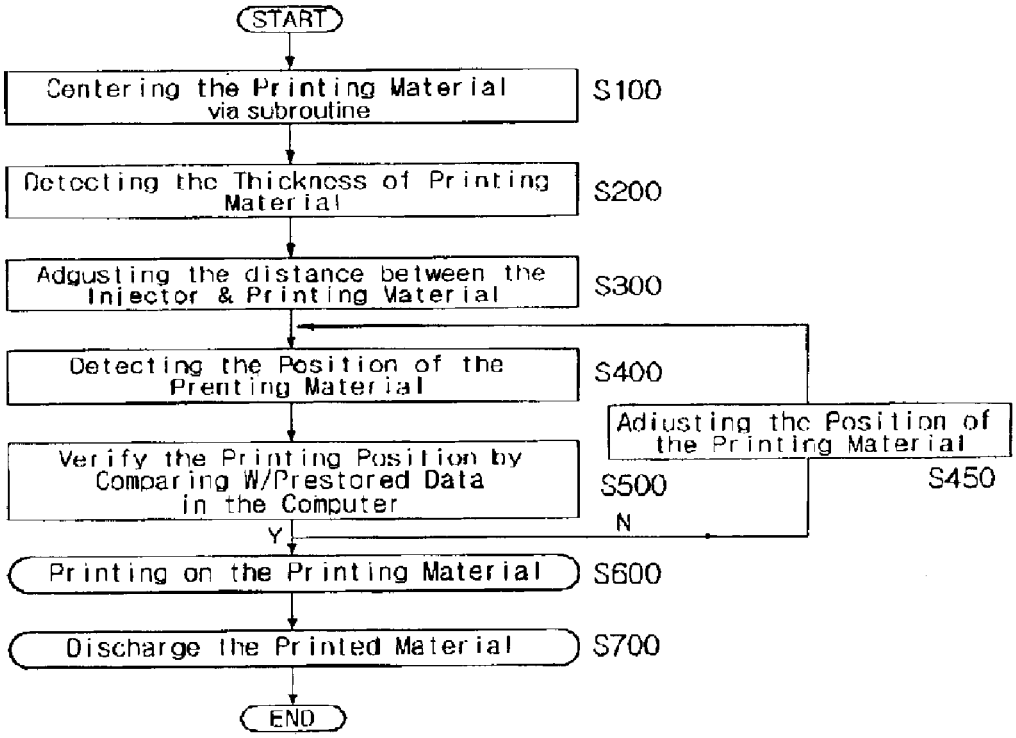
FIG. 14 is a flowchart illustrating a process for automatically adjusting the clearance between the inkjet nozzle and the printing material surface according to the present invention.
Figure 15:
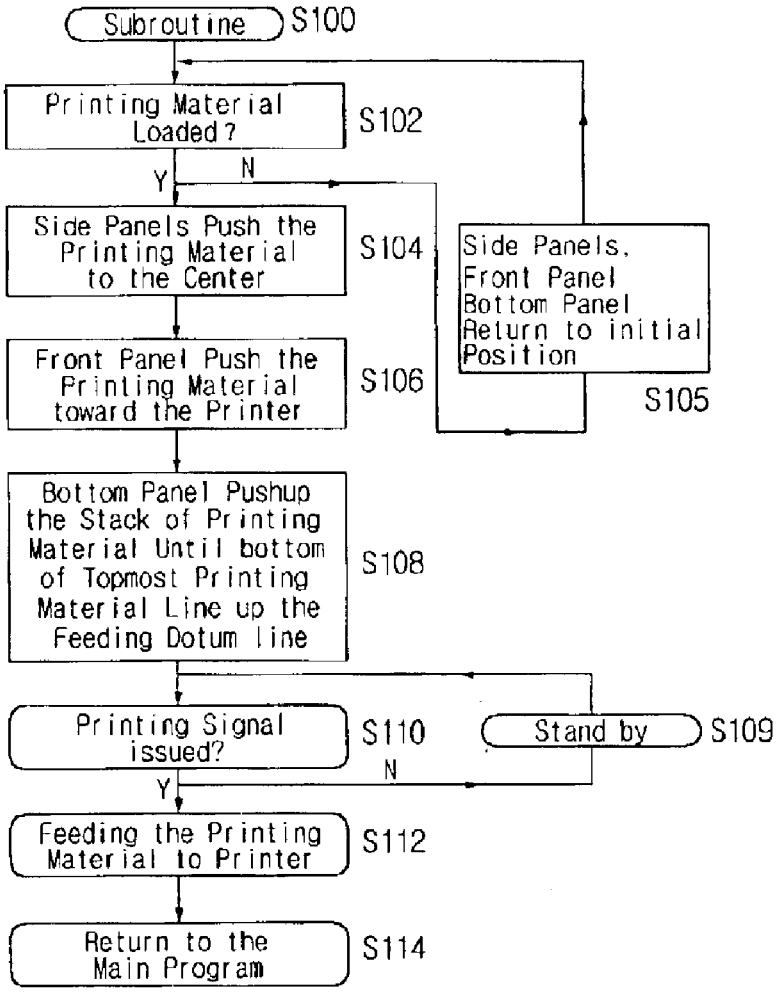
FIG. 15 is a subroutine for centering and aligning the printing materials in preparation for their being sent to the printer.
Figure 16:
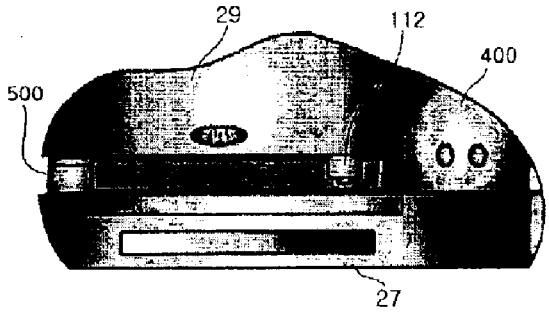
FIG. 16 shows a printer with a contemporary outer feature of the present invention.
Figure 17:
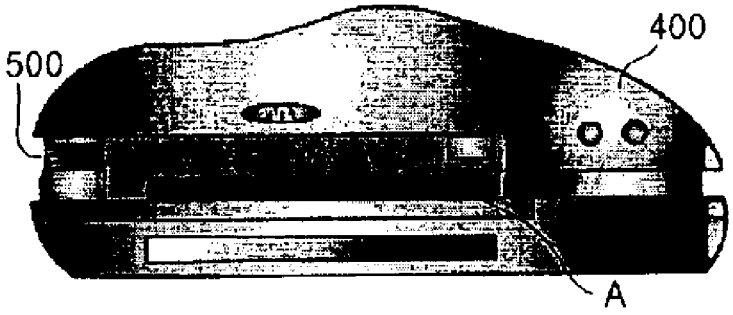
FIG. 17 shows a printing operation of thick printing material.
Figure 18:
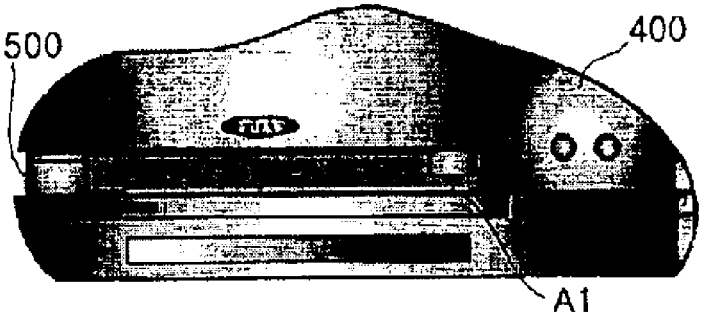
FIG. 18 shows a printing operation of regular stationery.
Figure 19:
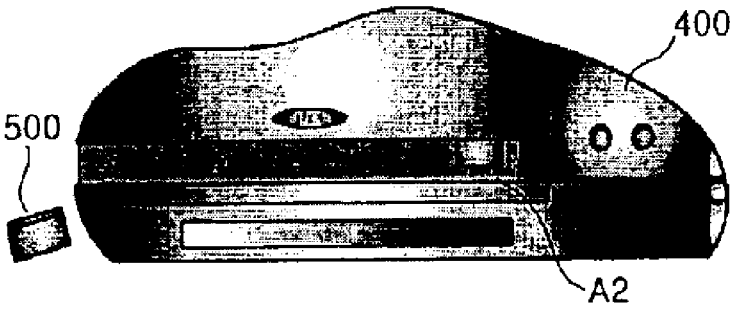
FIG. 19 shows an operating status of large-sized printing material.
Figure 20:
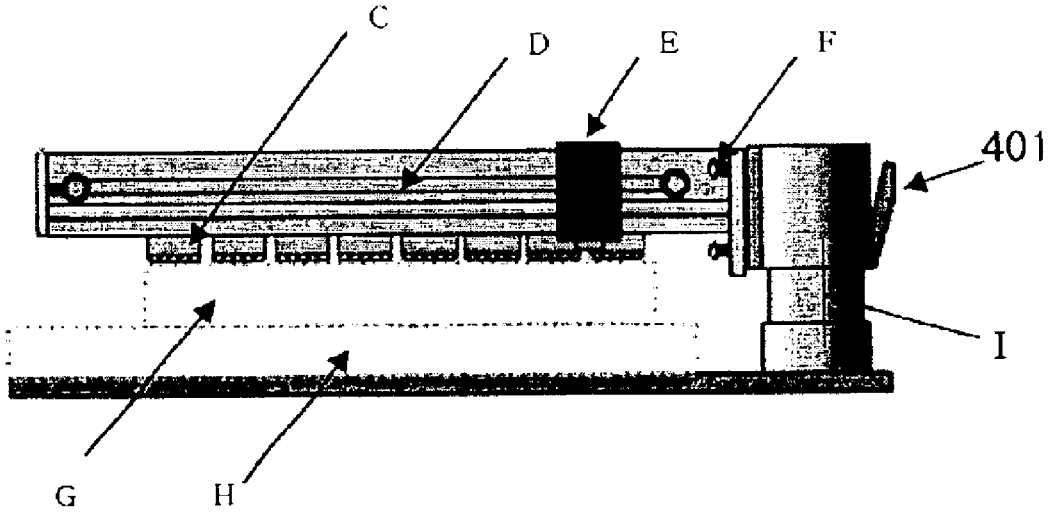
FIG. 20 shows another embodiment of a printer with a manual control lever according to the present invention.

Referring to FIGS. 14 and 15, a process for printing on the surface of thick, non-flexible printing material is described. During the printing process, the clearance between the ink injector and the printing material surface is adjusted automatically and continuously. When the printing material is loaded into the rack and the rack cover is closed, the sensor detects the completion-of-loading status. Then, both side panels move simultaneously forward to the centerline while pushing the printing material to the center until the sensor detects both side panels touching the printing material. At the same time, the front panel (14) pushes the loaded printing material to the front face of the printer until the loaded printing material touches the front face. Next, the bottom panel (13) raises the printing material up to the level at which the printing material may be fed into the inlet slot of the printer. A sensor in the rack detects the thickness of the loaded printing material for determining the raising increment of the printing material in the rack. At this point, if the printing signal is not issued, the printer is in standby mode for printing. If a printing signal is detected, the feeding mechanism pushes the printing material into the printer, and a sensor (23) located inside of the printer detects the thickness of the printing material and transmits the detected data to the computer processor. A pre-loaded program in the computer processor transforms the detected data into an electric signal. Then, the electric signal is transmitted to an actuator (24), which in turn operates the reversible drive motor (25). A secondary sensor detects the position of the fed printing material on the conveyor. The detected position is compared with the pre-loaded data in the computer processor. If the detected position does not coincide with the pre-loaded data, the printing position is adjusted to match the fed printing material on the conveyor. Then the detecting process is repeated to verify whether the detected position on the conveyor matches the printing position of the computer processor. If the detected position on the conveyor matches the printing position, printing is carried out. Once the printed material is discharged from the printer and loaded onto the receiving part, printing is completed.

As shown in FIG. 14, a process for automatically and continuously adjusting inkjet clearance between an inkjet nozzle and the printing material surface, such as a cartoon-board or a thick, non-flexible printing material, is described, the process comprising the steps of: centering and aligning the printing material via a subroutine (S100), detecting the thickness of the printing material (S200), adjusting inkjet clearance between the injector and the printing material surface (S300), detecting the position of the printing material (S400), verifying the printing position as compared with the position data pre-loaded in the computer (S500), adjusting the position data in the computer to coincide with the detected position of the printing material (S450), executing printing on the printing material (S600), and discharging the printed material to the receiving part (S700).

As shown in FIG. 15, a process for centering and aligning the printing material is disclosed. The subroutine process comprises the steps of: detecting whether printing material is loaded (S102), and, if printing material is not detected in the feeding rack (10), returning all of the side, front and bottom panels back to their initial positions (S105), or, if printing material is detected in the feeding rack (10), pushing the loaded printing material toward the centerline with the side panels (S104), pushing the loaded printing material toward the front portion of the printer with the front panel (S106), pushing the loaded printing material toward the inlet slot of the printer with the bottom panel (S108), determining whether a printing signal is issued (S110), and, if so, feeding the printing material (S112), or, if not, waiting until a printing signal is issued (S109), and returning to the main program (S114).

In case that a few thick, non-flexible printing material is printed, the process for centering and aligning the printing material is skipped. Alternatively, the thick, non-flexible printing material is fed into the inlet slot of the printer by manually, as shown in FIGS. 9*a* through 11*b*.

As described above, printing on cartoon-board or thick, non-flexible printing material, such as a book, a plastic board, CD, etc., is possible by adjusting inkjet clearance.

For printing on an oversized printing material surface, a process for automatically and continuously adjusting inkjet clearance is comprised of the steps of: disassembling the upper frame (29) of the printer, installing a pair of guide rails above the oversized printing material, setting the upper frame (29) of the printer on the pair of guide rails installed above the oversized printing material, connecting the upper frame (29) of the printer to the computer system, verifying the printing position as compared with the position data pre-loaded in the computer, adjusting the position data in the computer to coincide with the detected position of the printing material, and executing printing on the oversized printing material.

An alternative process of installing the pair of guide rails is comprised of the steps of: installing a pair of guide belts on the oversized printing material, and setting the upper frame (29) of the printer on the pair of guide belts installed above the oversized printing material.

As described, printing on oversized printing material, such as a metal structure, a plastic advertising board, or doors, etc., is possible when using the separable upper frame of printer.

As shown in FIGS. 16 through 19, a printer with the contemporary outer feature of the present invention is presented to show each printing operation status for thick printing material, regular stationery, and a large-sized printing material.

Figure 21:
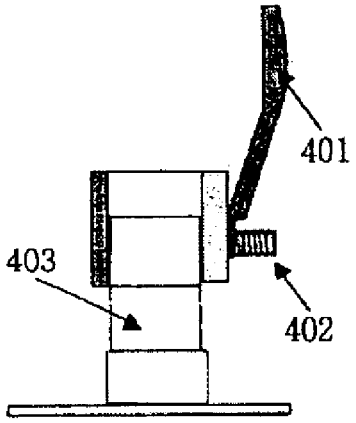
FIG. 21 shows a configuration of the detailed control lever.
Figure 22:
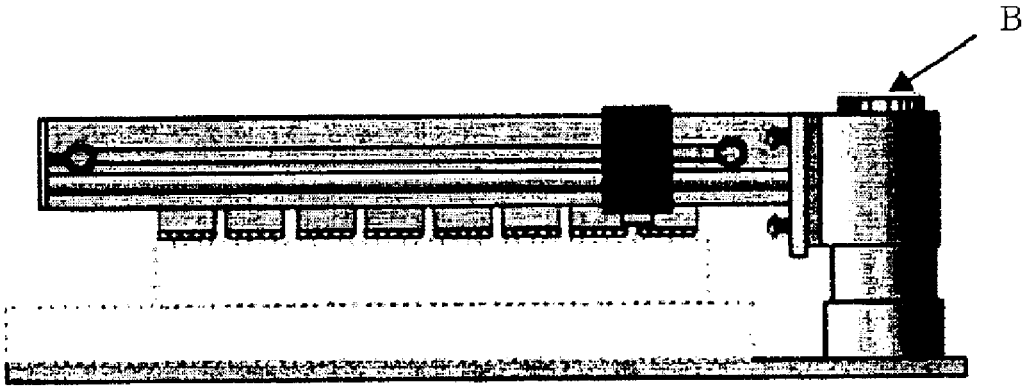
FIG. 22 shows another embodiment of a printer equipped with a manual control axle.
Figure 23:
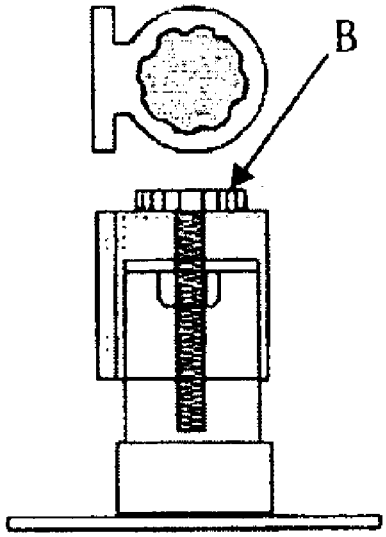
FIG. 23 shows a configuration of a detailed manual control axle.

Referring to FIGS. 20 through 23, a printer with a manual control system is disclosed. As shown in FIG. 21, a configuration of the control lever is used to manually control inkjet clearance. As shown in FIGS. 22 through 24, another type of manual control system is disclosed.

A configuration of a manual control axle is used for manually controlling inkjet clearance. A set of mechanisms is comprised of a control shaft (400) for manually adjusting inkjet clearance and an auxiliary shaft (500) for enabling instant installation or removal, depending upon the printing material thickness.

Figures 24A, 24B, 24C:
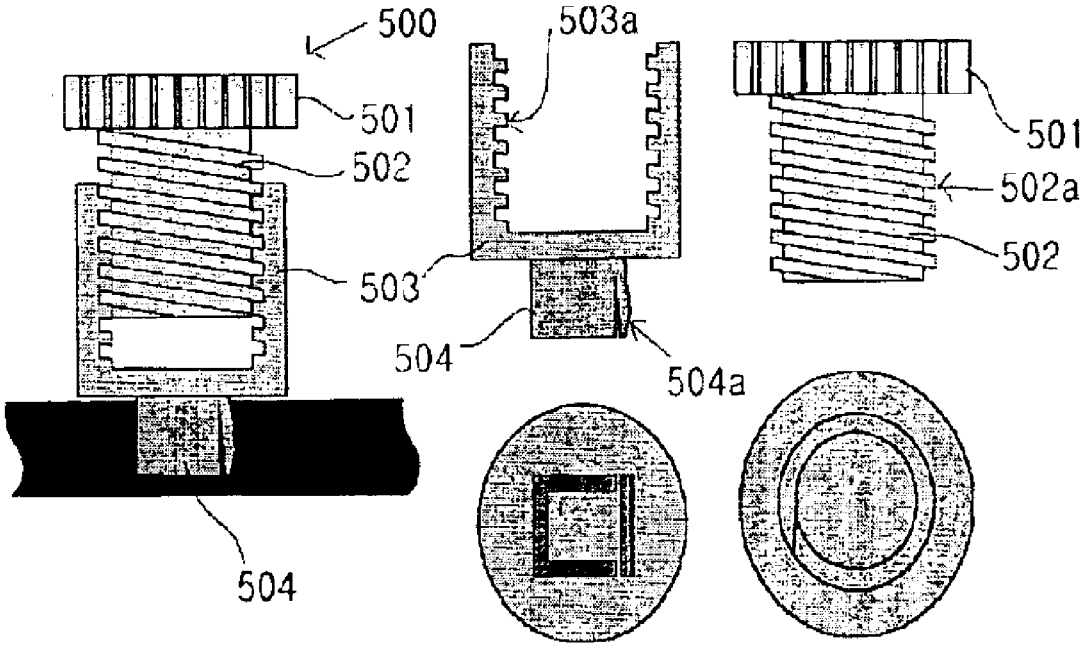
FIG. 24*a* shows an assembly of an auxiliary control axle for manually adjusting inkjet clearance.
FIG. 24*b* shows the female part of an auxiliary control axle.
FIG. 24*c* shows the male part of an auxiliary control axle.

As shown in FIGS. 24*a* through 24*c*, an auxiliary control axle discloses for manually adjusting inkjet clearance. An assembly of the auxiliary control axle, a female part and a male part of an auxiliary control axle are shown, respectively.

While the present invention has been described in detail with its preferred embodiments, it should be understood that further modifications are possible. The present application is therefore intended to cover any variations, uses or adaptations of the invention following the general principles thereof, and includes such departures from the present disclosure as come within known or customary practice in the art to which this invention pertains within the limits of the appended claims.

What is claimed is:

1. A printer having a capability of printing not only on regular stationery, but also on cartoon-board or thick, non-flexible printing material equips a function to adjust an inkjet clearance between an inkjet nozzle and printing material surface, said printer comprises:

a printing material feeding part (10) for supplying printing material to said printer, a main body of said printer (20) equipped with an operating menu for selecting a printing function using either regular stationery or thick, non-flexible printing material, said main body of the printer (20) formed a lower flame (27) and an upper frame (29), said lower frame (27) and said upper frame (29) being separable from each other, a set of mechanisms for operating said upper frame (29) linear movement of upward or downward to adjust the inkjet clearance, wherein said upper frame (29) further comprises:

a carriage mechanism (104) formed with an ink cartridge carriage (112) installed on a carriage shaft (110) for horizontally traveling rightward or leftward along the carriage shaft (110) extended to the horizontal edges, a carriage drive motor (116) for driving said ink cartridge carriage (112) installed on the frame, a rear driving roller (222) and a rear drive motor (220) for driving said rear roller installed at rear part of said upper frame (29), a friction roller (128) in a friction roller assembly (108), which roller partially juts out from a bottom line of the upper frame (29), said rear driving roller (222) which juts out from the bottom line of said upper frame (29), a jutted portion of said rear driving roller (222) being aligned with a jutted portion of said friction roller (128) in the same horizontal line, and said friction roller assembly (108) equipped with a feed roller (114), engaged with said friction roller (128) of said lower frame (27) for feeding printing material.

2. A printer as claimed in claim 1, wherein said set of mechanisms for adjusting the inkjet clearance further comprise:

a sensor (23) for detecting a thickness of the printing material, a computer program pre-loaded in a computer processor for controlling and adjusting the inkjet clearance based on the detected data from the sensor (23), an actuator (24) receiving a control signal from the computer processor for driving a reversible motor (25), and a set of power transmitting mechanisms consists of a plurality of bevel gears, power transmitting shafts, guiding rods and supporting bearings.

3. A printer as claimed in claim 1, wherein said set of mechanisms for adjusting the inkjet clearance further comprises:

a sensor (23) for detecting a thickness of the printing material, a computer program pre-loaded in a computer processor for controlling and adjusting the inkjet clearance based on the detected data from the sensor (23), and an electromagnetic actuator (31, 32) receiving a control signal from the computer processor and exerting electromagnetic power to said upper frame (29) for linear movement.

4. A printer as claimed in claim 1, wherein said lower frame (27) further comprises:

a line feed mechanism (102) with a feed roller (114), a line feed motor (118) for driving said feed roller (114), and a paper-feeding tray (103) aligned with said line feed mechanism (102) and said line feed motor (118) for loading printing material.

5. A printer as claimed in claim 1, wherein said printing material feeding part (10) further comprises a top feeder for regular stationery and a horizontal or level feeder for cartoon-board or thick, non-flexible printing material.

6. A printer as claimed in claim 1, wherein said line feed mechanism (102) of the lower frame (27) further comprises a belt system (606, 607).

7. A printer as claimed in claim 1, wherein said set of mechanisms further comprises a control shaft (400) for manually adjusting the inkjet clearance.

8. A printer as claimed in claim 7, wherein said control shaft (400) for manually adjusting the inkjet clearance further comprises an auxiliary shaft (500) which enables instant installation or removal depending on the thickness of the printing material.

* * * * *